US005119662A

United States Patent [19]

Sunaga et al.

[11] Patent Number: 5,119,662

[45] Date of Patent: * Jun. 9, 1992

[54] METHODS FOR COLD DRAWING SEAMLESS METAL TUBES EACH HAVING AN UPSET PORTION ON EACH END

[75] Inventors: Yutaka Sunaga; Toshio Sakurai, both of Yokohama, Japan

[73] Assignee: Sanwa Kokan Co., Ltd., Yokohama, Japan

[ * ] Notice: The portion of the term of this patent subsequent to Feb. 23, 2005 has been disclaimed.

[21] Appl. No.: 636,012

[22] Filed: Jan. 4, 1991

Related U.S. Application Data

[60] Continuation of Ser. No. 349,882, May 10, 1989, abandoned, which is a continuation of Ser. No. 85,030, Aug. 13, 1987, abandoned, which is a continuation-in-part of Ser. No. 858,179, May 1, 1986, Pat. No. 4,726,211, which is a division of Ser. No. 599,825, Apr. 13, 1984, Pat. No. 4,606,212.

[51] Int. Cl.[5] ..... B21C 1/24

[52] U.S. Cl. ..... 72/283

[58] Field of Search ..... 72/283, 276, 291, 285

[56] References Cited

U.S. PATENT DOCUMENTS

| | | | |
|---|---|---|---|
| 295,898 | 4/1884 | Billings | 72/291 |
| 565,726 | 8/1896 | De Los Rice | 72/283 |
| 600,014 | 3/1898 | McCool | 72/283 |
| 2,240,456 | 4/1941 | Darner | 72/283 |

FOREIGN PATENT DOCUMENTS

| | | | |
|---|---|---|---|
| 129875 | 4/1902 | Fed. Rep. of Germany | 72/276 |
| 2448283 | 6/1975 | Fed. Rep. of Germany | 72/283 |
| 3016135 | 10/1981 | Fed. Rep. of Germany | 72/283 |
| 3021481 | 12/1981 | Fed. Rep. of Germany | 72/283 |
| 3133804 | 5/1983 | Fed. Rep. of Germany | 72/276 |
| 716815 | 12/1931 | France | 72/283 |
| 2326993 | 5/1977 | France | 72/276 |
| 24048 | 10/1964 | Japan | 72/276 |
| 31426 | 2/1982 | Japan | 72/283 |
| 93511 | 6/1983 | Japan | 72/283 |
| 99429 | 10/1961 | Netherlands | 72/283 |
| 606306 | 8/1949 | United Kingdom | 72/276 |

*Primary Examiner*—Daniel C. Crane
*Attorney, Agent, or Firm*—Wenderoth, Lind & Ponack

[57] ABSTRACT

A method of and a device for cold drawing seamless metal tubes, each tube having an upset portion on both ends. The draw bench comprises a reducing die, a die control unit, a plug control unit including a plug and a draw unit. The reducing die has an internal surface including an inlet portion which tapers rearwardly, a small diameter bearing portion and an oppositely inclined outlet portion. A plug includes a rearwardly tapered portion, a large diameter bearing portion, a forwardly tapered portion, a small diameter cylindrical portion, a rearwardly tapered portion and a large diameter cylindrical forward bearing portion. The plug control unit is mainly movable with respect to the die control unit by a pair of hydraulic units, but the control unit is also movable with respect to the plug control unit for changing a cross sectional reducing area between the reducing die and the plug.

3 Claims, 15 Drawing Sheets

METHODS FOR COLD DRAWING SEAMLESS METAL TUBES EACH HAVING AN UPSET PORTION ON EACH END

CROSS REFERENCE TO RELATED APPLICATIONS

This application is a continuation of now abandoned application, Ser. No. 07/349,882 filed on May 10, 1989 which in turn is a continuation of application Ser. No. 07/085,030, filed Aug. 13, 1987, now abandoned, which in turn is a continuation-in-part of appln. Ser. No. 06/858,179, filed May 1, 1986 now U.S. Pat. No. 4,726,211, which in turn is a division of appln. Ser. No. 06/599,825, filed Apr. 13, 1984, now U.S. Pat. No. 4,606,212.

1. BACKGROUND OF INVENTION 1-1. Field of the Invention

This invention relates to methods of and devices for cold drawing seamless metal tubes each having an upset portion on each end.

These seamless metal tubes are preferably used for drilling tubes, casings, inner rods and outer rods for geological, mineralogical, metallurgical or geothermal research and/or drilling for civil engineering or water wells.

1-2. Prior Art

With reference to FIGS. 1(*a*) to 4(*b*) showing the seamless metal tubes which have been produced by the conventional method using the conventional draw bench, a hot forged thin wall midbody 7*c* of a metal tube is welded at each end with a thick wall end tube 7*b* in order to obtain a large diameter seamless metal tube or pipe 7 having an upset portion 7*b* on both ends.

Otherwise, the seamless metal tube is produced by casting or lathing, but metallic filaments in such a seamless metal tube are axially cut at welded or lathed portions or at blowholes, which are likely to cause cracks in the seamless metal tube after heat treatment at high temperature.

To this end, a draw bench for drawing the seamless metal tube has been proposed. For example, a small diameter and thin wall seamless metal tube having a diameter of 25–35 mm and a wall thickness of 2.1–3.2 mm such as for a bicycle framework is cold drawn through the draw bench shown in FIGS. 2(*a*)–4(*b*).

The conventional draw bench, which is shown in FIGS. 2(*a*) and 2(*b*), for drawing such seamless metal tubes comprises a bed 12 to be fixed on the floor, a die holder 26 which is mounted at a middle portion on the bed 12 and a closed periphery reducing die 2 which is concentrically mounted in the die holder 26. A pair of tongs 6 and a bearing are arranged on the entry side of the bed 12 for horizontally supporting a plug fixing rod 88.

Secured to a front portion of the rod 88 is a plug 4 which is inserted into the reducing die 2 when drawing.

A draw unit 110 is arranged on the exit side of the bed 12 and comprises a carriage 112 mounted on rollers travelling on the bed 12, the carriage 112 carrying a hook 118 and a chuck 114 for gripping the front tip 7*a* of the mother tube or workpiece 7. The carriage 112 is driven by an endless chain 120 encompassing a driven sprocket wheel (not shown) mounted in the bed 12. The driving sprocket wheel is coupled by any known means with an electric motor (not shown). The hook 118 is engaged with the endless chain 120 when drawing. The front tip 7*a* of the mother tube 7 engaged by jaws 116 of the chuck 114 is strongly pulled by the carriage 112 to draw the tube 7 having an upset portion 7*b* on both ends.

FIGS. 3(*a*) and 3(*b*) show the conventional manner of drawing seamless metal tubes which have the same outer diameter but unequal inner diameter upset portions on both ends. In FIG. 3(*a*), a plug 4 is held adjacent to a tapered entry in the axial bore of the reducing die 2 with a clearance to the inner periphery of the mother tube 7 to draw the portion of the mother tube 7 having the small inner diameter upset portion 7*b* on both ends, while the plug 4 in FIG. 3(*b*) is held right in the bore of the reducing die 2 to draw the portion of the tube 7 having a larger inner diameter.

FIGS. 4(*a*) and 4(*b*) show another conventional drawing method. The reducing die 2 has an internal surface including an inlet portion 2*b* which tapers forwardly toward the bearing or throat portion 2*a* and an oppositely inclined outlet portion 2*c*. When the enlarged front portion 4*a* of the plug is held right in the bearing portion 2*a* of the reducing die 2, the mother tube 7 is drawn through the bearing portion 2*a* and over the enlarged front portion 4*a* into a drawn tube having a small outer diameter.

In FIG. 4(*b*), the enlarged front portion 4*a* of the plug 4 is passed leftwards across the bearing portion 2*a* and located adjacent to the outlet portion 2*c*. Then the mother tube 7 is drawn through the bearing portion 2*a* and around the small diameter portion 4*b* of the plug 4 to reduce the outer diameter of the drawn tube.

The mother tube 7 is further advanced into the front region where the inner diameter of the mother tube 7 is widened by the enlarged front portion 4*a* of the plug 4 in order to draw a tube 7 having the same inner diameter as that of the enlarged front portion 4*a* of the plug 4 and also having an outer diameter upset portion 7*b* larger than that of the drawn tube 7 produced through the reducing die 2 shown in FIG. 4(*a*).

The seamless metal tubes 7 drawn through the conventional reducing die 2 have the following disadvantages.

(1) The seamless mother tube 7 having a small inner diameter is drawn under reduction through the reducing die 2 shown in FIG. 3(*a*) without any internal radial pressure, thus resulting in corrugation in and around the drawn tube.

(2) In FIG. 4(*b*), the mother tube 7 is drawn through the reducing die 2 with the plug 4 held in the bearing portion 2*a* and in the tube 7 to obtain the drawn tube 7 having one outer diameter but two different inner diameter upset portions 7*b*. The tube drawn through the bearing portion 2*a* and over and around the small diameter portion 4*b* of the plug 4 is widened by the enlarged front portion 4*a* of the plug 4 to obtain the drawn tube shown in FIGS. 7(*a*) and, 7(*b*), wherein d4 denotes a large diameter bearing portion of the plug 4, d2 denotes a bearing portion diameter of the reducing die 2, d1 denotes a large diameter of the drawn tube 7, and d3 denotes a small diameter bearing portion of the plug 4 respectively.

Accordingly, d4 becomes an inner diameter of the drawn tube 7 and d2 becomes a small outer diameter of the drawn tube 7, but the large diameter d1 of the drawn tube 7 does not directly connect the bearing portion diameters of the the reducing die 2 and the plug 4, but it gives the following functional formaul:

$$d1 = f(d2, d3, d4)$$

But we cannot determine the values of d1, d2 and d4 independently. In order to fix the most preferable values for d1, d2 and d4, it is necessary to select the value sufficiently near the most suitable value among the various solutions of the functional formula of $$d1 = f(d2, d3, d4)$$

We cannot, however, obtain the most suitable values for the diameters of d1, d2 and d4.

(3) The configuration of the drawn tube is limited to only two kinds, i.e.

(a) one having one outer diameter but two unequal inner diameters;

(b) another having one inner diameter but two unequal outer diameters.

(4) The drawing force of the plug 4 is so small that the plug 4 may be driven to transfer by a hydraulic cylinder, while it needs to provide a balancing unit or a plurality of hydraulic cylinders to balance the reaction upon the strong drawing force of the plug, thus making the device complicated and expensive.

SUMMARY AND OBJECTS OF THE INVENTION

A principal object of this invention is to provide a novel and improved method of cold drawing seamless metal tubes which have an upset portion on both ends.

Another object of this invention is to provide a novel and improved method of cold drawing seamless metal tubes wherein a reducing area between a reducing die and a plug is radially changed to draw a seamless metal tube having an upset portion on each end.

Another object of this invention is to provide a method which is sufficiently reliable and reproductive to ensure that each and every mother tube is ready to undergo drawing under reduction for forming unequal diameter upset portions on both ends.

Another object of this invention is to provide a method of cold drawing a seamless metal tube whereby a reducing die and a plug having unequal diameter bearing portions are movable with respect to each other and are fixed at the selected positions in order to draw a seamless metal tube having an upset portion on both ends.

Another object of this invention is to provide a method of cold drawing a seamless metal tube having an upset portion on both ends whereby the reducing die and the plug are longitudinally movable to a number of different positions but remain at a standstill once they assume the selected positions to obtain a plurality of reducing areas between the reducing die and the plug.

Another object of this invention is to provide a method of cold drawing a seamless metal tube having an upset portion on each end without forging, casting or welding.

Another object of this invention is to provide a method of cold drawing a seamless metal tube having an upset portion on each end which has no alteration in the structure, in strength of the upset end portion and of the midbody of the drawn tube, but has dimensional stability in all areas thereof.

Another object of this invention is to provide a method of cold drawing a seamless metal tube having an upset portion on each end which has no scales, but has tighter tolerance, thus enabling the tubes to be threaded without prior machining.

Another object of this invention is to provide a draw bench for cold drawing a seamless metal tube having an upset portion on each end whereby precise threading can be remarkably improved.

Another object of this invention is to provide a device for cold drawing a seamless metal tube having an upset portion at each end.

Another object of this invention is to provide a device having a hydraulic unit whereby a reducing area between a reducing die and a plug is radially changed to draw a seamless metal tube having an upset portion at each end.

Another object of this invention is to provide a device which comprises a plug control unit having a plug whereby an inner upset portion and an outer upset portion of a drawn tube can be formed successively.

Another object of this invention is to provide a device which comprises a plug control unit whereby an outer upset portion is formed on each end.

Still another object of this invention is to provide a draw bench which can be driven easily, quietely and smoothly.

BRIEF DESCRIPTION OF THE DRAWINGS

The nature of this invention will be clear from the following detailed description of particular embodiments of the proposed method of producing seamless metal tubes by cold drawing and of the draw bench when taken with the accompanying drawings, in which:

FIG. 2(*b*) is an enlarged detailed vertical sectional view of a reducing die, a plug and a mother tube shown in FIG. 2(*a*), particularly showing that the mother tube is being drawn through the reducing die around the plug;

FIG. 5(*b*) is a greatly enlarged vertical sectional view of the die control unit of the draw bench shown in FIG. 5(*a*);

FIG. 5(*c*) is a greatly enlarged vertical sectional view of the hydraulic cylinder which is secured to a rear face of the die holder shown in FIGS. 5(*a*) and 5(*b*);

FIG. 7(*b*) is an enlarged vertical section similar to FIG. 7(*a*), with the large diameter bearing portion of the plug located at the small diameter bearing portion of the reducing die;

FIG. 7(*c*) is also an enlarged vertical section similar to FIG. 7(*a*), with the large diameter bearing portion of the plug located at the forwardly tapered outlet portion;

FIG. 8(*b*) is a partial cross section similar to FIG. 8(*a*), showing the second drawing step and with the forward small diameter portion of the plug located at the small diameter bearing portion;

FIG. 8(*c*) is a partial cross section similar to FIGS. 8(*a*) and (*b*), showing the third drawing step and with the forward small diameter portion of the plug located at the large diameter bearing portion of the reducing die;

FIG. 8(*d*) is a similar cross section of FIGS. 8(*a*)-(*c*), showing the fourth drawing step and with the large diameter bearing portion of the plug located at the small diameter reducing die;

FIG. 8(*e*) is a partial cross section similar to FIG. 8(*a*), showing the fifth drawing step and with the large diameter bearing portion of the plug located at the small diameter bearing portion of the reducing die;

FIG. 8(*f*) is a cross section similar to the foregoing drawings, showing the sixth drawing step and with the reducing die returned to the position shown by the solid line;

FIG. 8(*g*) is a cross section similar to FIG. 8(*f*), showing the seventh drawing step;

FIG. 8(*h*) is a cross section similar to FIGS. 8(*f*) and (*g*), showing the eighth drawing step;

FIG. 9(*b*) is a cross section similar to FIG. 9(*a*), showing the second drawing step and with the forward large diameter cylindrical bearing portion of the plug located at the small diameter bearing portion of the reducing die;

FIG. 9(*c*) is a similar cross section of FIGS. 9(*a*) and (*b*), showing that the plug is advanced in the third drawing step to locate the small diameter middle portion thereof at the small diameter bearing portion of the reducing die;

FIG. 9(*d*) is a cross section similar to FIG. 9(*c*), showing the fourth drawing step, wherein the plug and the reducing die are fixed so as to form an outer upset portion on one end of the drawn tube;

FIG. 9(*e*) is a cross section similar to FIGS. 9(*a*)-(*d*), showing the fifth drawing step for drawing a thin midbody portion of the drawn tube;

FIG. 9(*f*) is the same cross section as FIG. 9(*e*), showing the further drawing step of forming the thin midbody portion of the drawn tube;

FIG. 9(*g*) is the same cross section as FIGS. 9(*c*) and (*d*), showing that the plug is moved back to the original positions shown in the foregoing drawings in order to draw an outer upset portion on another end of the drawn tube;

DETAILED DESCRIPTION OF THE PREFERRED EMBODIMENTS

Figure 2B:
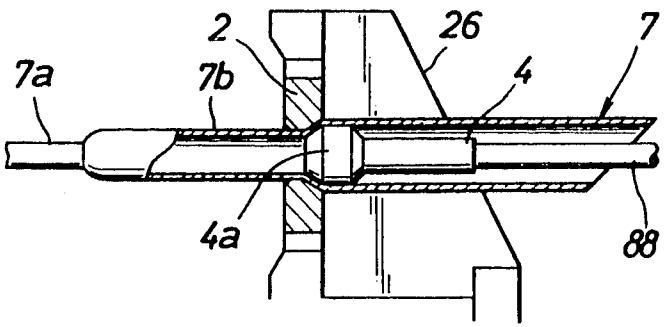
FIG. 2(*a*) is a side elevation of a conventional draw bench, with its chain drive portion of a draw unit partially cut away.
Figure 1:
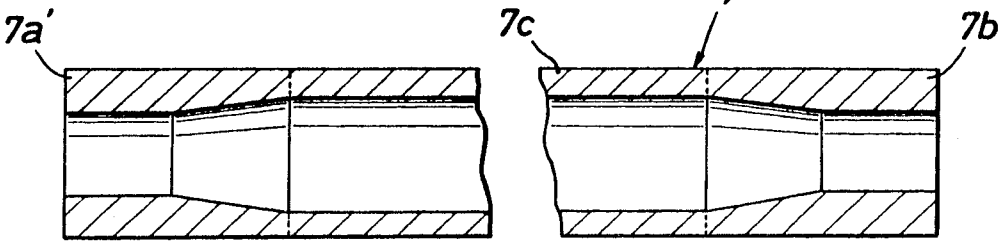
FIG. 1 is a cross section of a seamless metal tube made by a conventional process such as by casting, lathing or hot forging, with its midbody partiatially cut away.
Figure 2A:
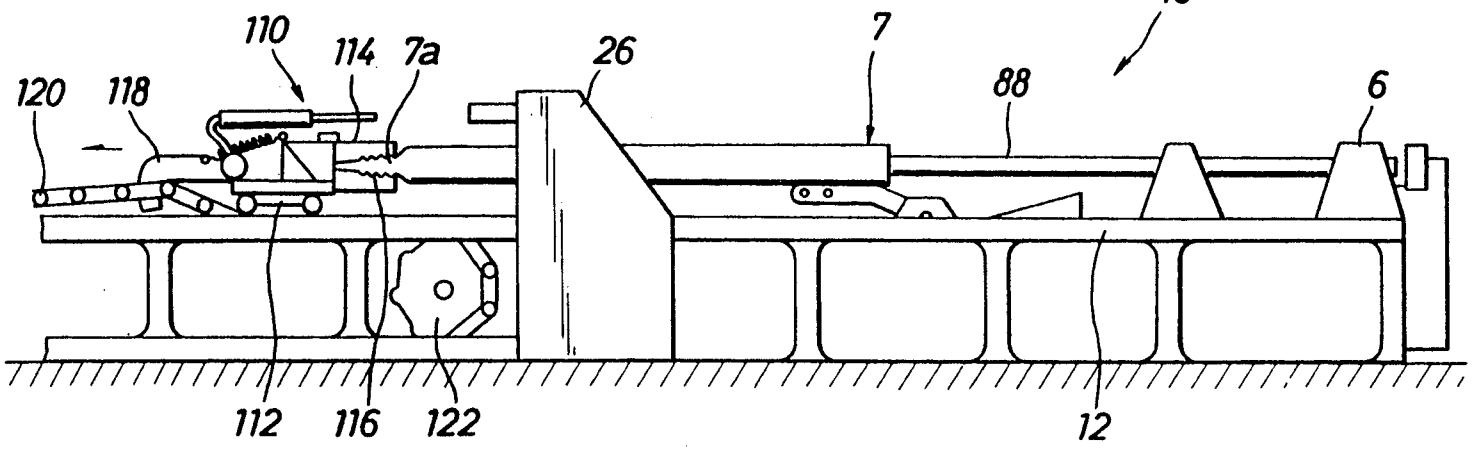
Figure 3A:
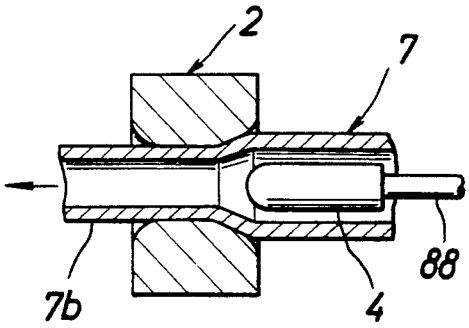
FIGS. 3(*a*) and 3(*b*) are fragmentary axial sectional views of a reducing die and modified plug, showing conventional drawing steps for forming ordinary seamless metal tubes.
Figure 3B:
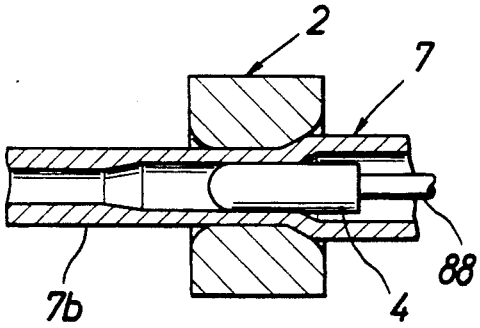
Figure 4A:
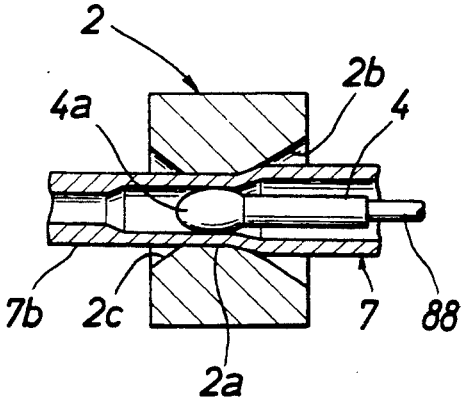
FIGS. 4(*a*) and 4(*b*) are fragmentary axial sectional views of a modified reducing die and modified plug, showing conventional drawing steps for forming ordinary seamless metal tubes.
Figure 4B:
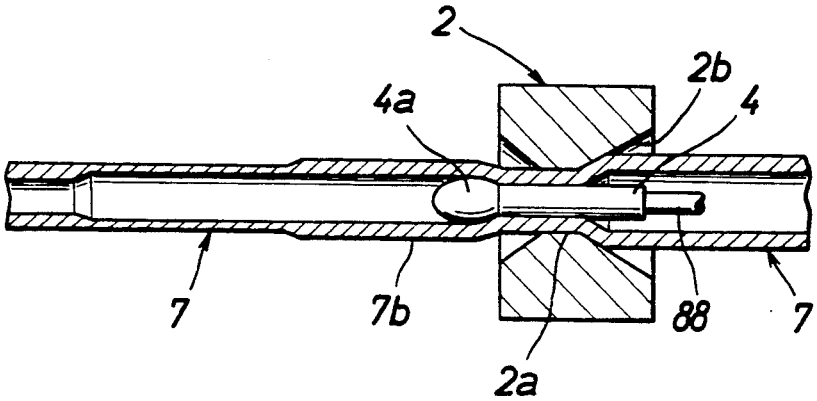
Figure 5:
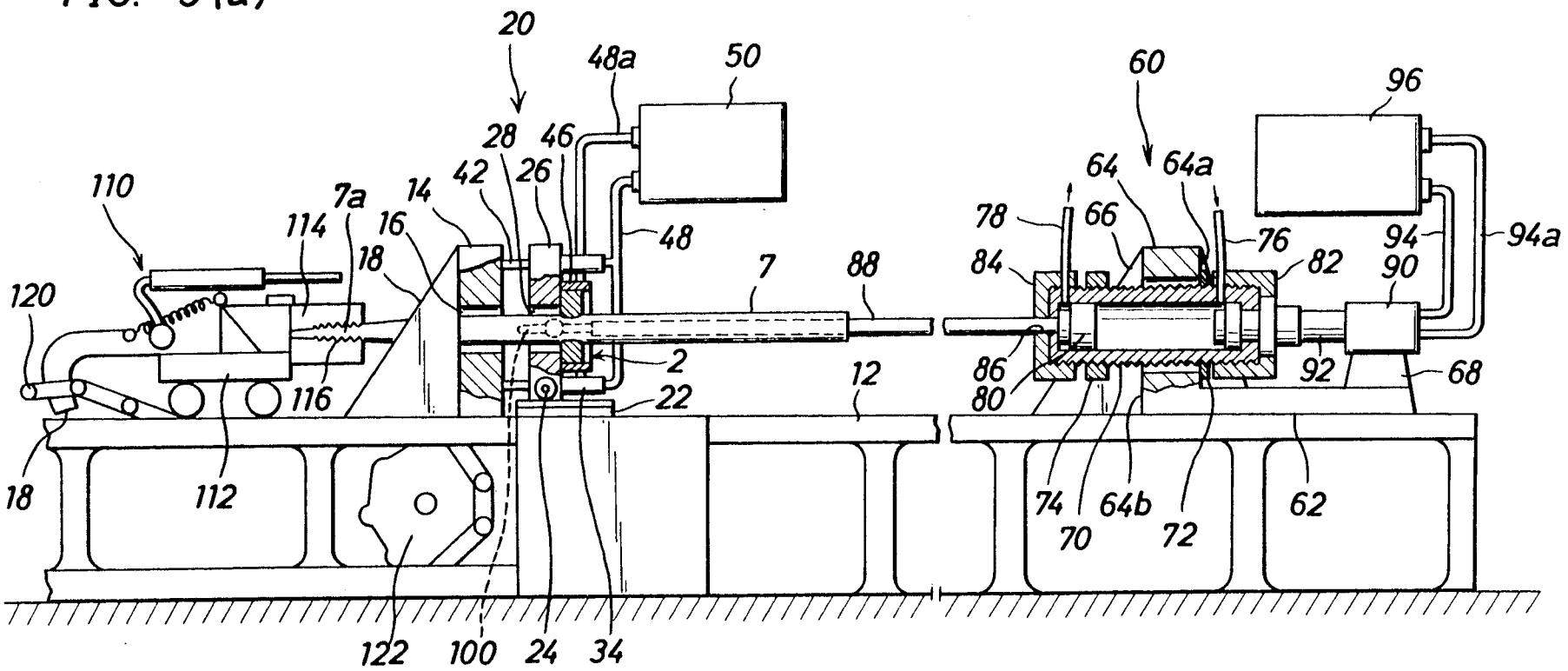
FIG. 5(*a*) is a side elevation, partly in section, of the draw bench which embodies one form of the present invention.
Figure 5C:
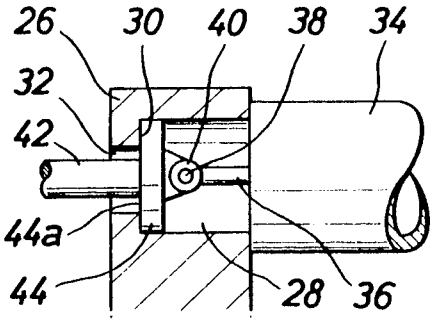
Figure 5B:
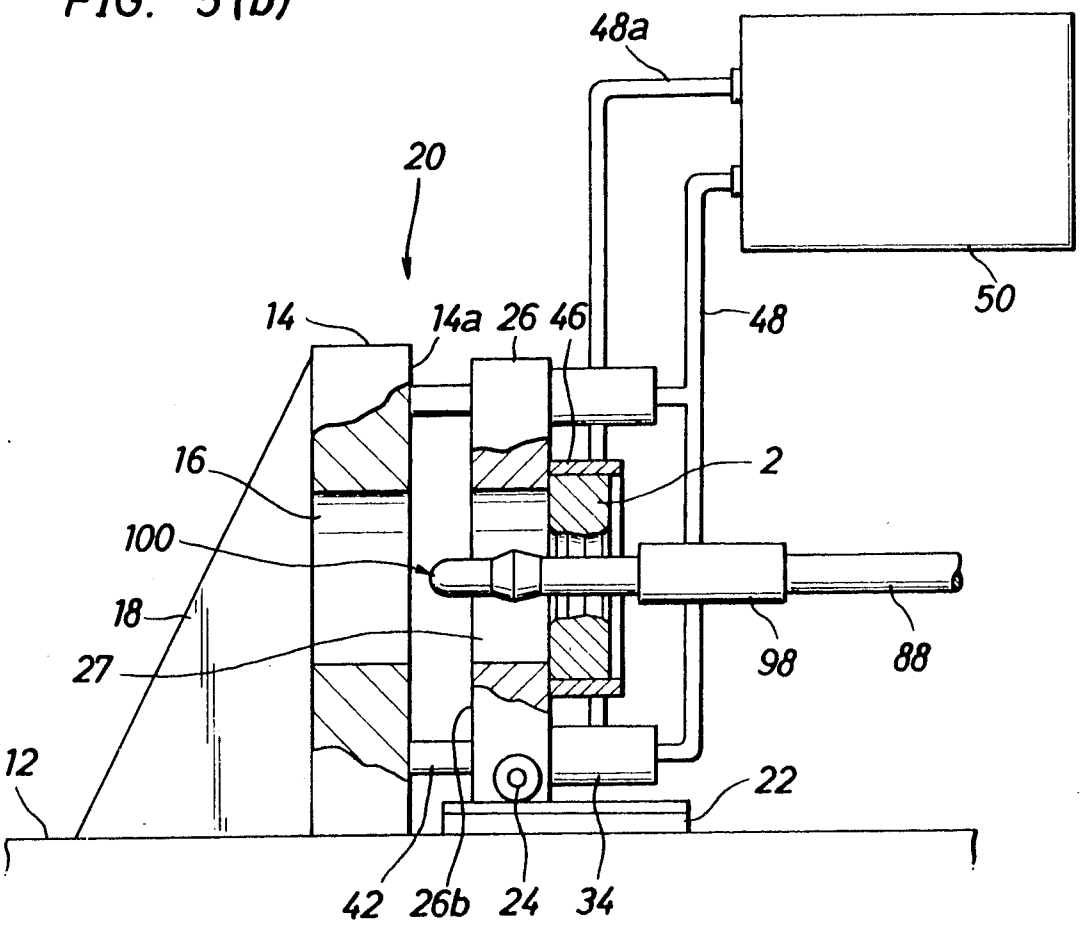

Proceeding now with the detailed description of the drawings, we turn first to FIGS. 5(*a*) through 6 illustrating this invention. The draw bench 10 in accordance with this invention comprises a bed 12 which is usually fixed on the floor, a front stopper 14 which is mounted at the middle portion on the bed 12 and is reinforced by a reinforcing member 18, the stopper 14 having a central large opening 16.

In FIGS. 5(*a*) and 5(*b*), the die control unit 20, which is arranged on the bed 12 and adjacent to the front stopper 14, includes a rail 22 mounted longitudinally on the bed 12, and a carriage 24 movably mounted on the rail 22. A die holder 26 which is provided on the carriage 24 and having a central large diameter opening 27 is rigidly provided on the carriage 24 and a cylindrical holder 46 including a closed periphery reducing die 2 is secured to a rear face of the die holder 26 to abut upon the central large diameter opening 27 of the die holder 26.

A pair of hydraulic cylinders 34 are laterally provided at the diametrically peripheral portions on the rear face of the die holder 26, each end portion of the hydraulic cylinders is penetrated through the die holder 26 and connected to the rear face 14*a* of the front stopper 14 by means of a pair of rams 42.

As particularly shown in FIG. 5(*c*), a pair of cylindrical hollow portions (cavities) 28 are laterally formed into the die holder 26 from its rear face and near its outer periphery, and a small opening 32 is laterally provided through an innermost wall 30 of each cavity 28. A large diameter flange 44 of a ram 42 is inserted into the hollow portion 28, the ram extending through the small opening 32 and being connected to the rear face of the front stopper 14. The front end of the piston 36 of the hydraulic cylinder 34 is coupled to a male lug 40 which is provided at a central rear face of the large diameter flange 44, and the front end of the hydraulic cylinder 34 is secured to the die holder 26 to abut upon the hollow portion 28 thereof.

In this way, the front face 44*a* of the large diameter flange 44 provided at the end of the ram 42 is brought into contact with the innermost portion 30 of the cylindrical hollow portion 28 when the piston (not shown) within the hydraulic cylinder 34 is advanced forwardly.

The hydraulic cylinder 34 produces a pushing force which is larger than a tube drawing force of for instance 150-200 tons. In order to fix the die holder 26 at the desired position, the large diameter flange 44 is preferably brought into contact with the innermost portion 30. The hydraulic cylinders 34 are connected to a hydraulic unit 50 by a pair of pipes 48 and 48*a*.

Figure 6:
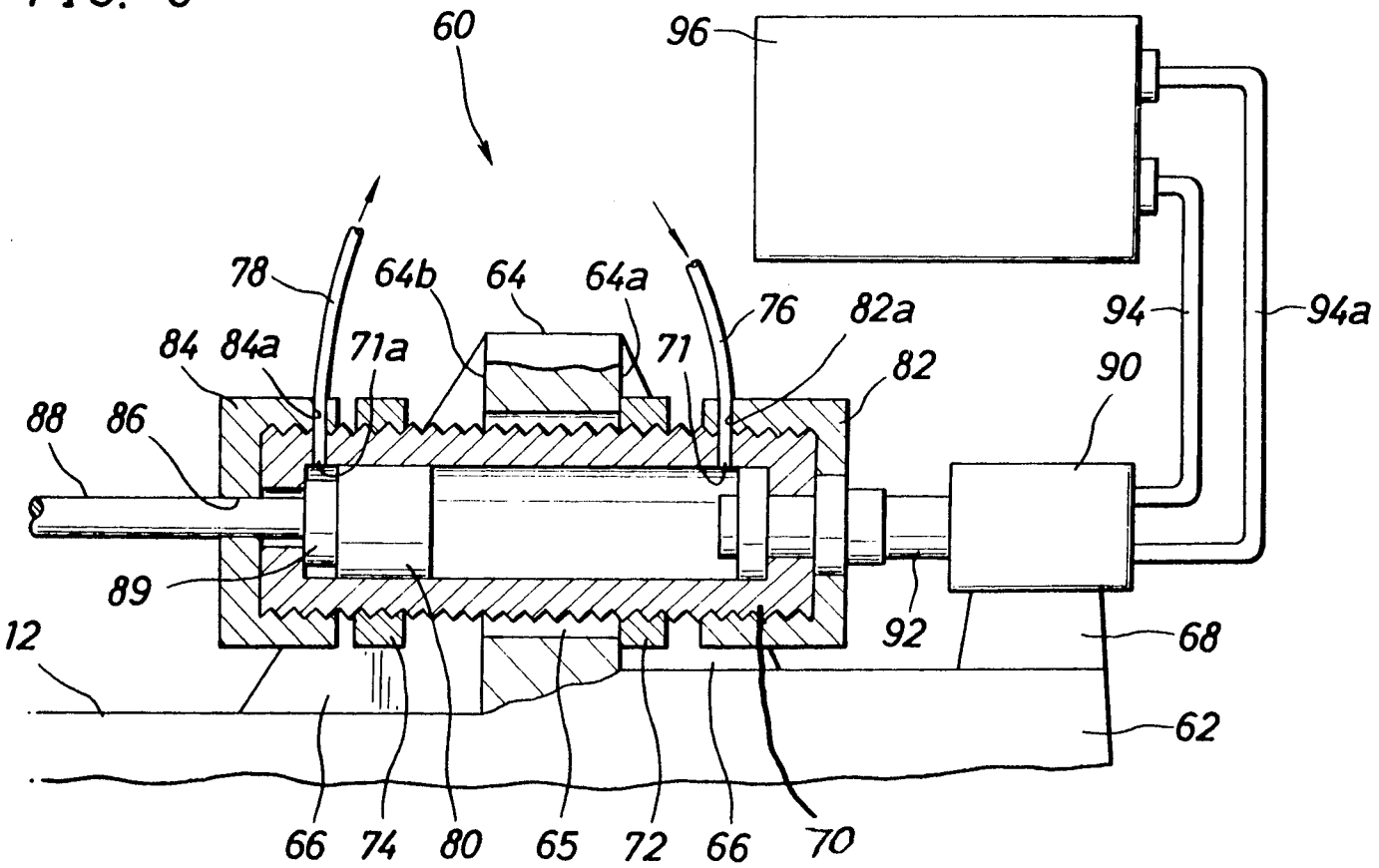
FIG. 6 is a greatly enlarged vertical sectional view of of the hydraulic cylinder which is secured to a rear face of the die holder shown in FIGS. 5(*a*) and 5(*b*)

A plug control unit 60 shown in FIG. 6 is arranged on the bed 12 at the entry side thereof and coaxially with the die control unit 20. The plug control unit 60 includes a base 62 which is rigidly mounted on the bed 12, a rear stopper 64 having a central lateral opening 65, and a rear post 68, the rear stopper 64 being reinforced on both sides by a pair of reinforcing members 66.

A leading screw compressed-air cylinder 70 having a small radially extending opening 71 through a periphery extends rotatably and slidably through the central lateral opening 65, and a pair of screw nuts 72 and 74 are threadedly screwed on the extending portions of the compressed-air cylinder 70.

A rear end cover 82 having a small radially extending opening 82*a* is threadedly screwed on the rear end of the cylinder 70 to align the opening 82*a* with the opening 71, and a compressed-air supply pipe 76 is inserted into the small opening 82*a*. A front cover 84 having a central opening 86 and a small radially extending opening 84*a* is threadedly screwed on the front portion of the cylinder 70. Prior to screwing of the front cover 84, the rear portion of a push-pull main rod 88 is closely fitted through the central opening 86 of the front cover 84 to allow a large diameter flange 89 and a piston 80 to be located within the hollow cylinder 70. The exhaust flexible pipe 78 is inserted into the small opening 84*a*. The large diameter flange 89 of the push-pull main rod 88 is connected to the piston 80 within the cylinder 70.

A front portion of a hydraulic cylinder 90 which is laterally mounted on the rear post 68 is coupled to the rear end of the cylinder 70 by a ram 92, the rear end of which is connected to a hydraulic unit 96 by a pair of pipes 94 and 94*a*.

Figure 7A:
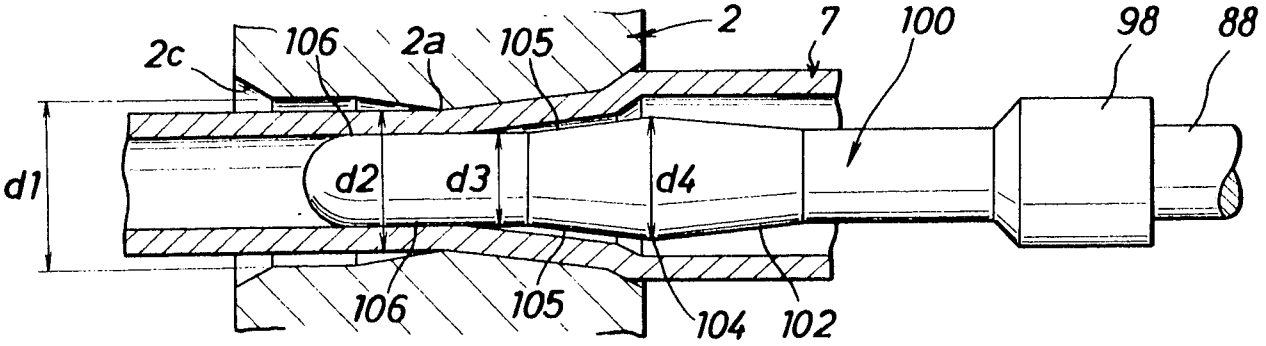
FIG. 7(*a*) is an enlarged vertical section of the reducing die, the mother tube and the plug of this invention, for drawing a seamless metal tube shown in FIG. 10, with its large diameter bearing of the plug approaching an inlet portion of the reducing die.
Figure 7B:
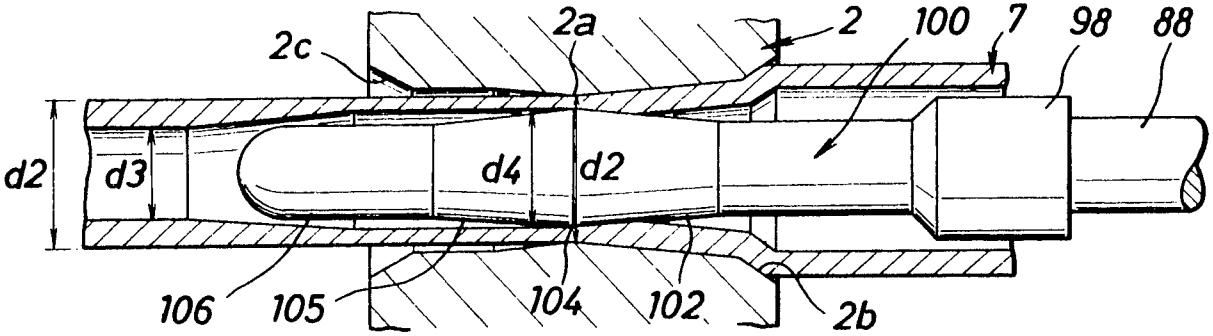
Figure 7C:
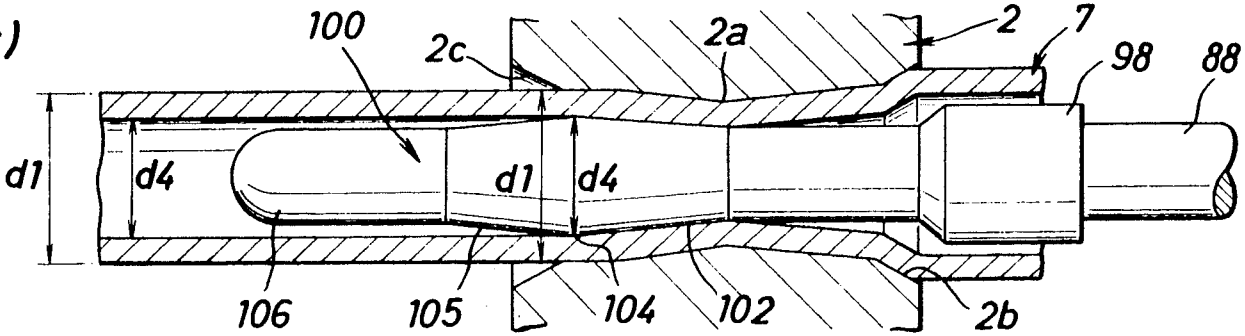
Figure 8A:
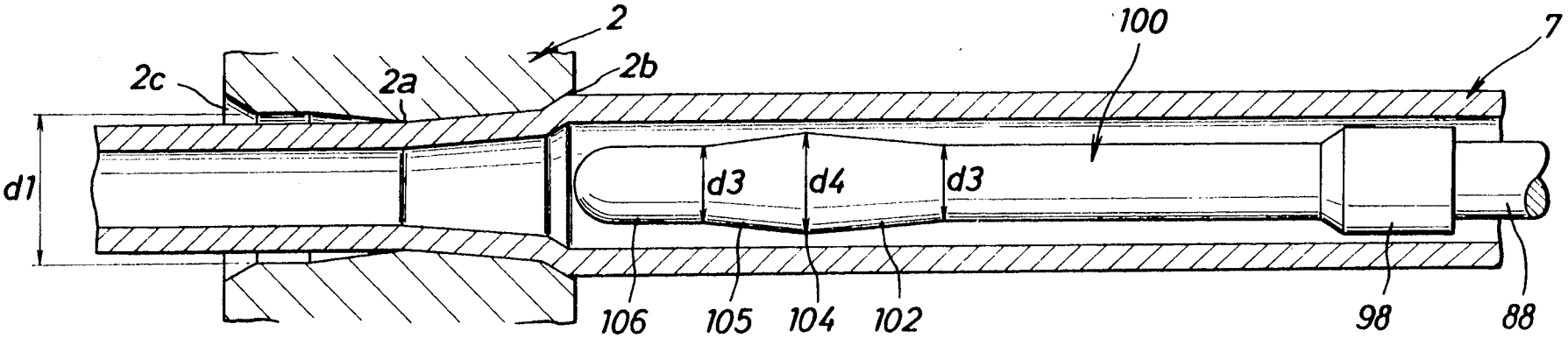
FIG. 8(*a*) is a partial cross section of the reducing die, the mother tube and the modified plug, showing the first step for drawing the seamless metal tube shown in FIG. 11, with the forward small diameter portion of the plug located at at the inlet portion of the reducing.
Figure 8B:
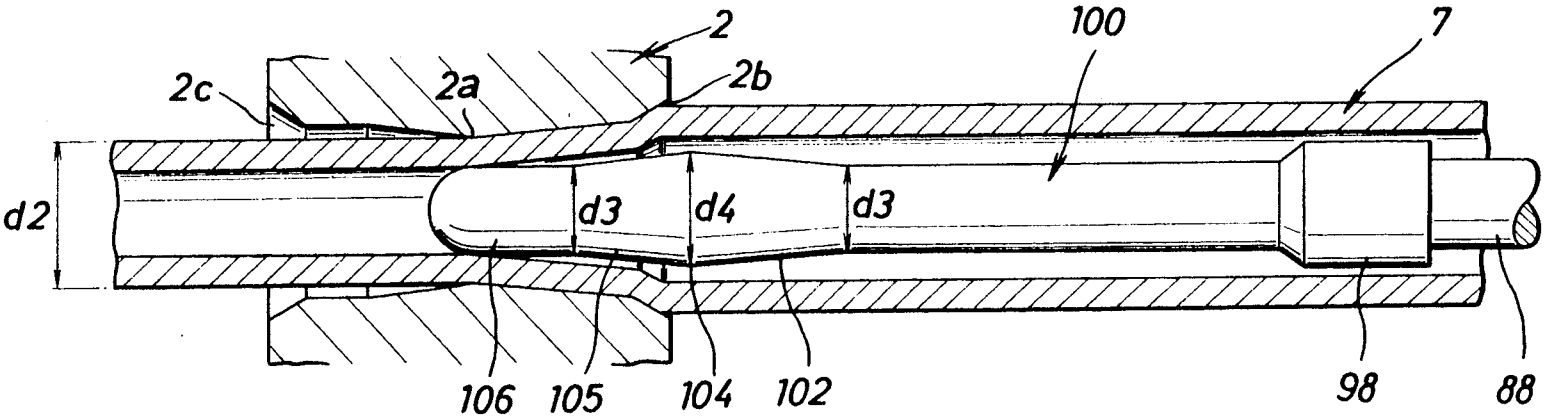
Figure 8C:
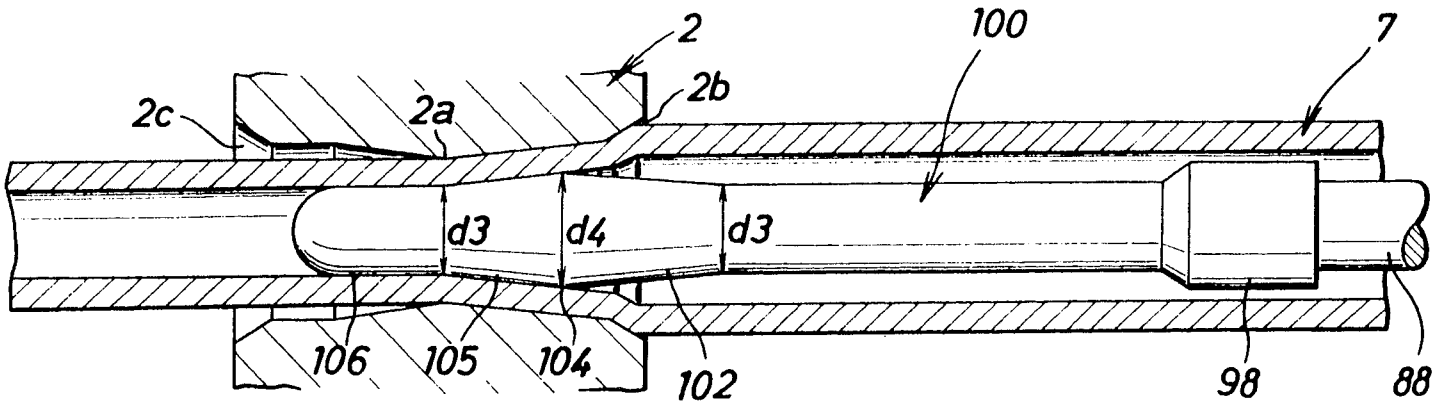
Figure 8D:
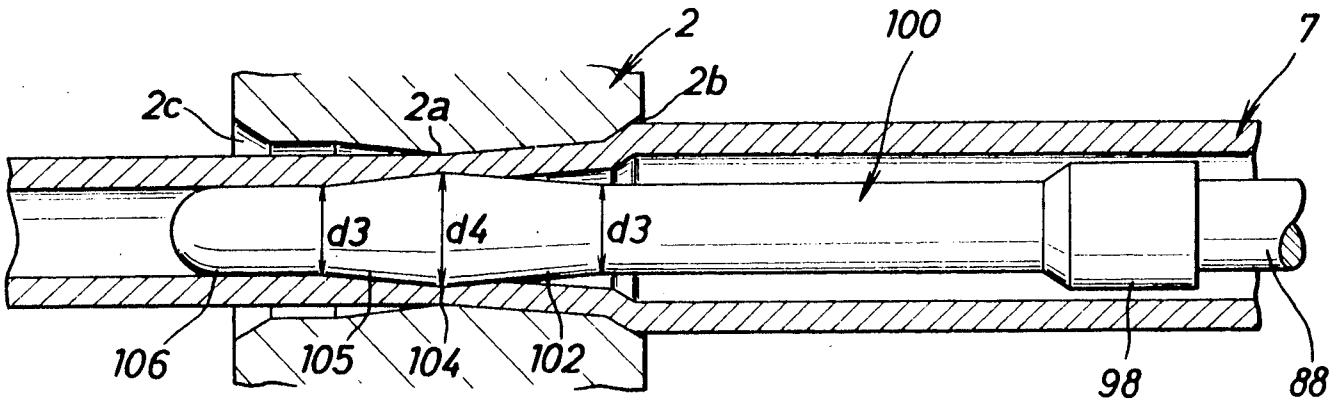
Figure 8E:
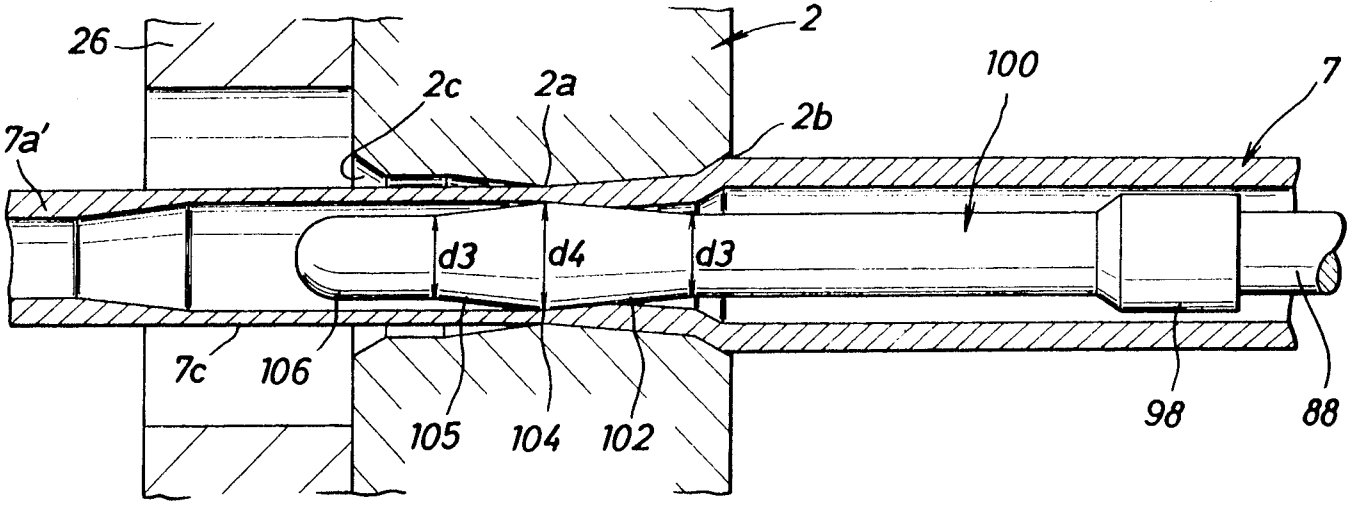
Figure 8F:
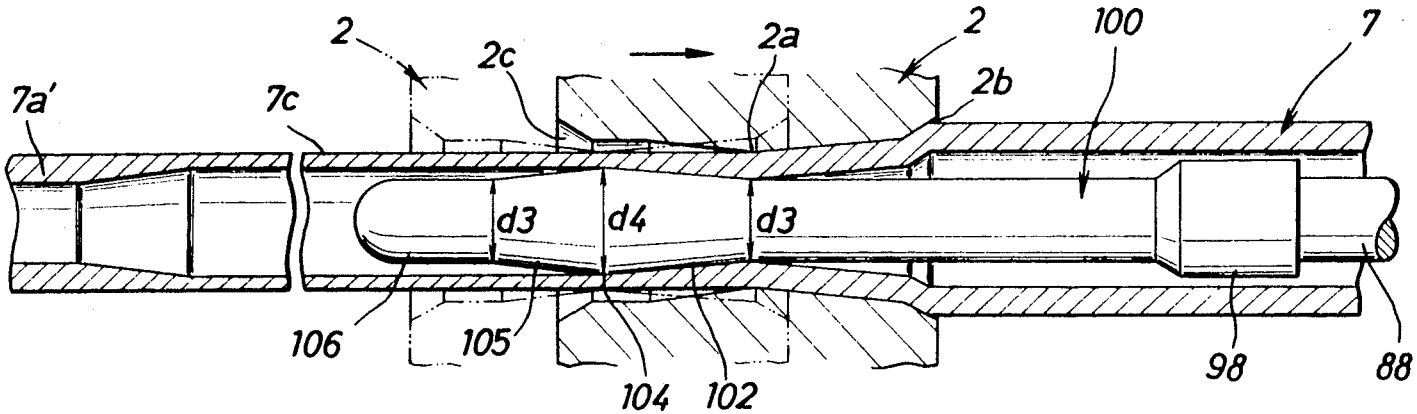
Figure 8G:
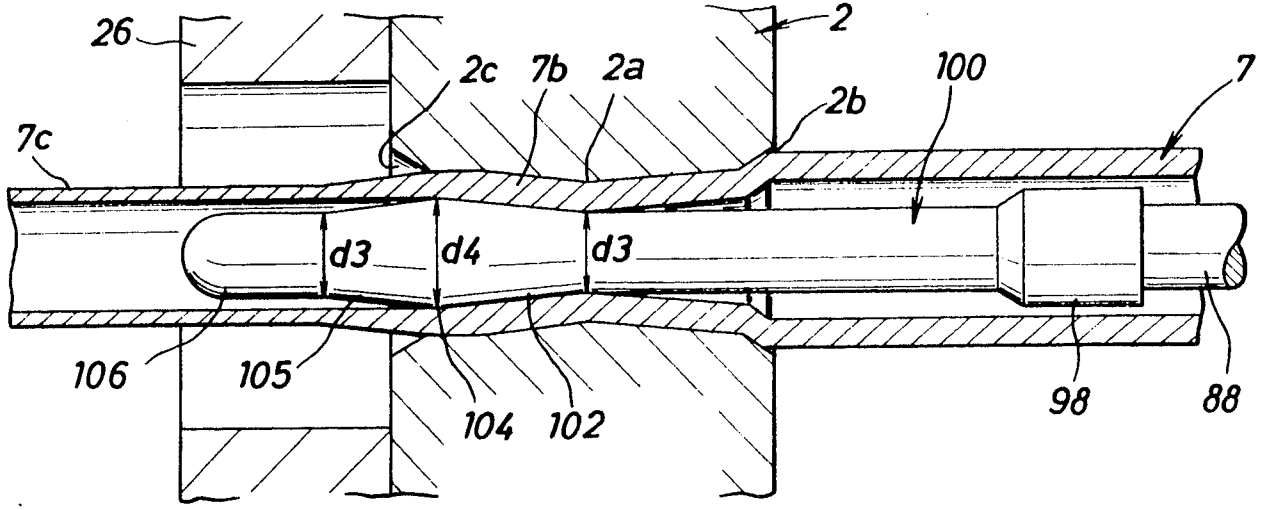
Figure 8H:
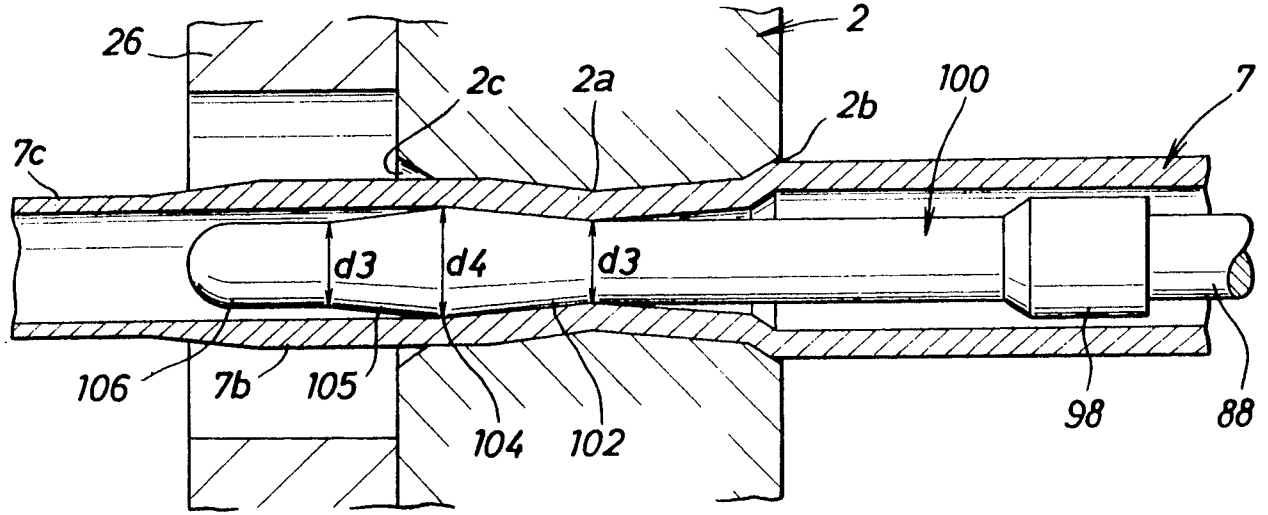
Figure 9A:
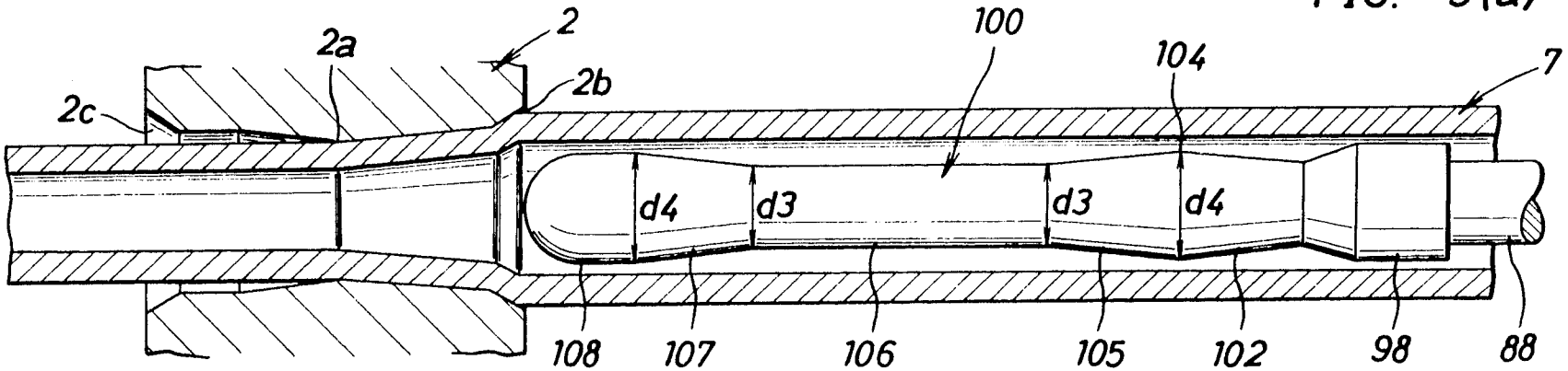
FIG. 9(*a*) is a partial cross section of the reducing die, the mother tube and the modified plug, showing the first step for drawing the seamless metal tube shown in FIG. 12, with the forward large diameter cylindrical bearing portion of the plug located at the inlet portion of the reducing die.
Figure 9B:
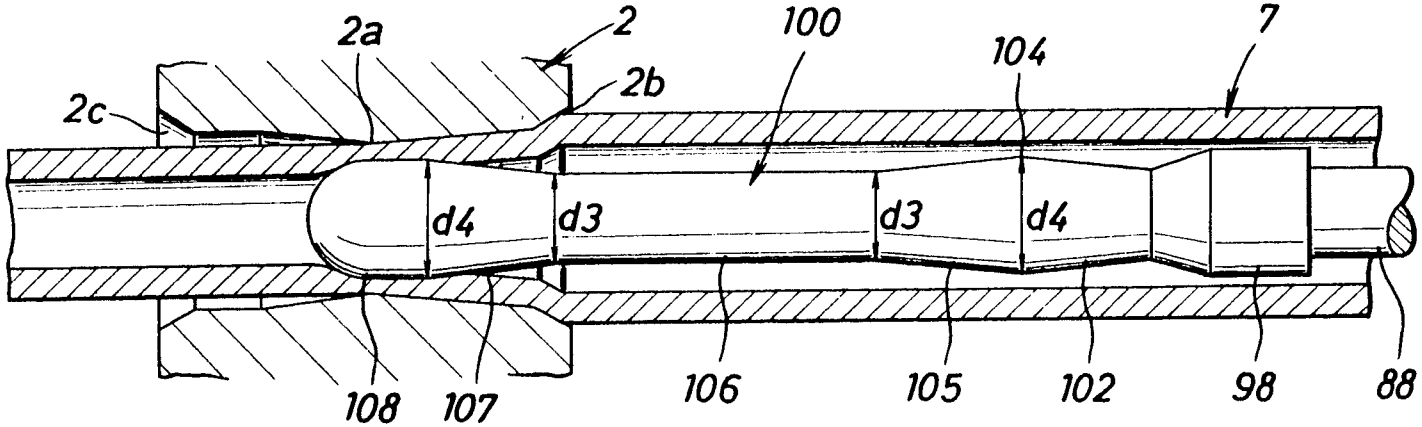
Figure 9C:
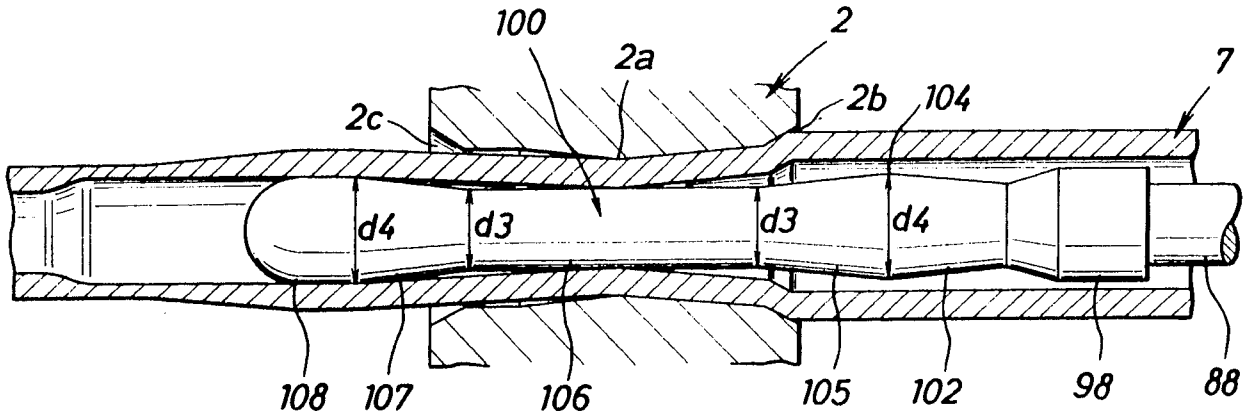
Figure 9D:
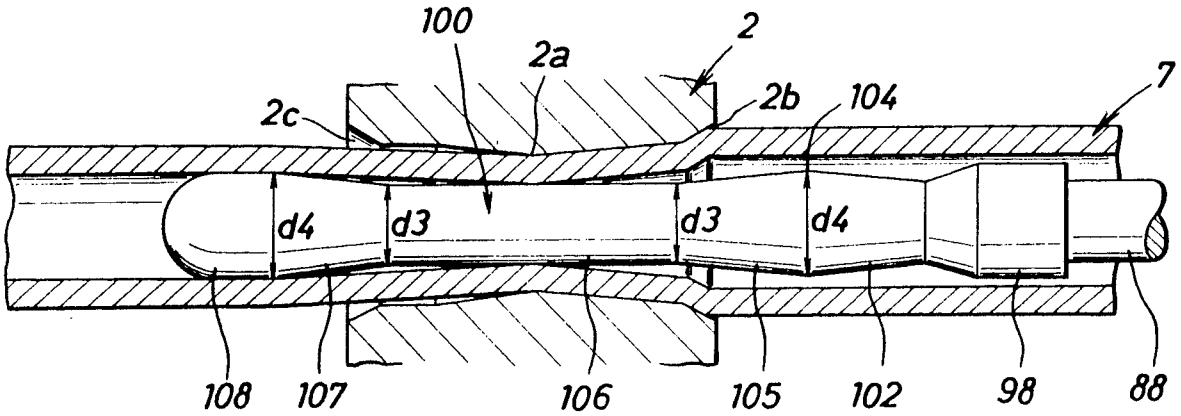
Figure 9E:
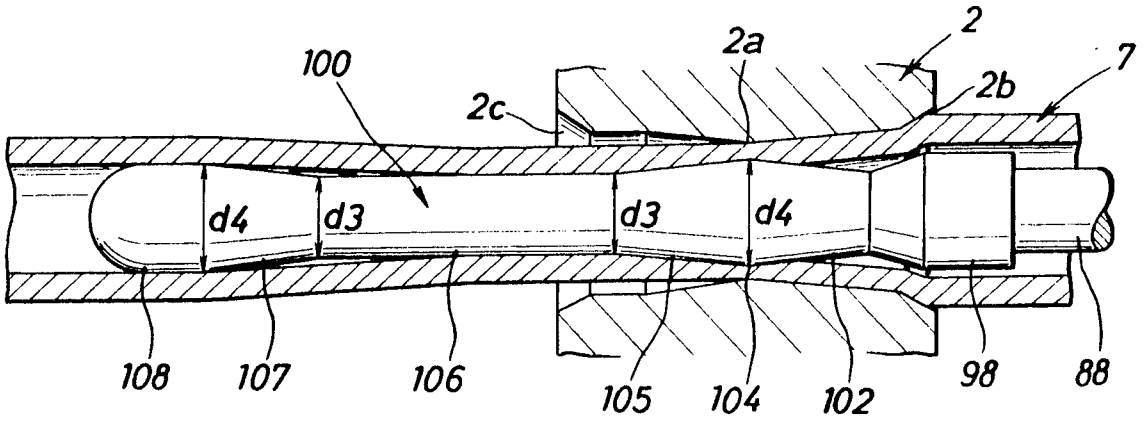
Figure 9F:
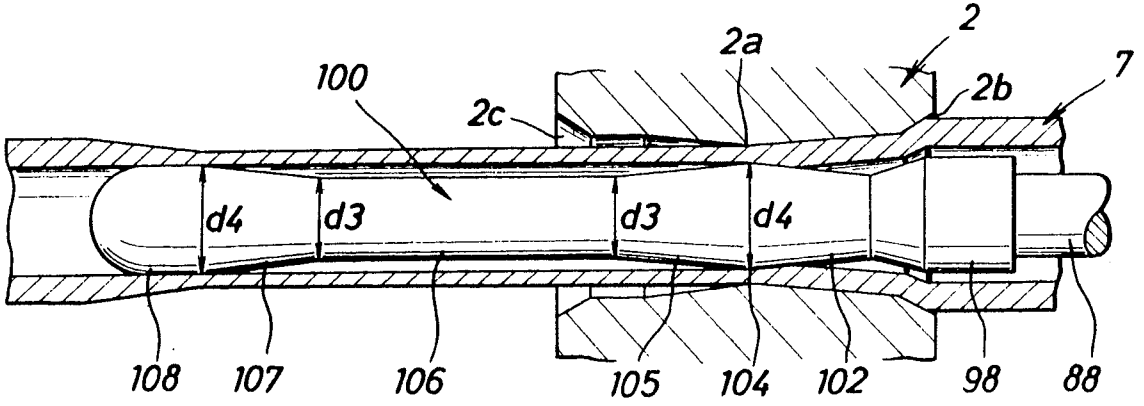
Figure 9G:
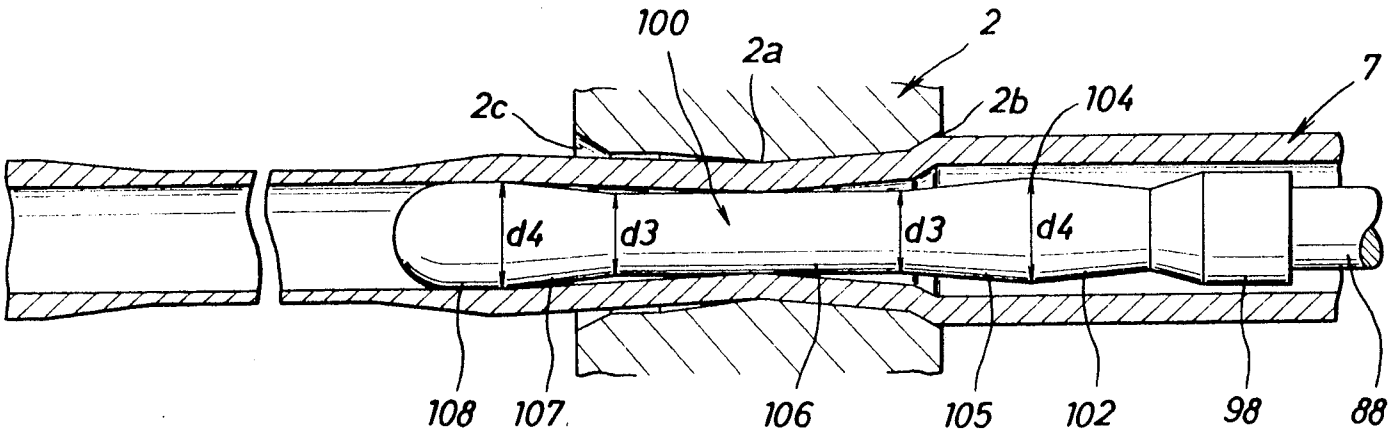

As shown in FIGS. 7(*a*)–7(*b*), a plug 100 is secured to a front end portion of the push-pull main rod 88 by a shank 98, and the plug 100 includes a rearwardly tapered portion 102, a large diameter bearing portion 104(d4), a forwardly tapered portion 105 and a forward small diameter portion 106 (d3) which are shaped forwardly in the stated order.

In accordance with the draw bench 10 of this invention, the left screw nut 74 is rotatably brought into contact with the front face 64*b* of the rear stopper 64 to determine the right fixed position, while the right screw nut 72 is rotatably brought into contact with the rear face 64*a* thereof to determine the left fixed position.

For drawing, the reducing die 2 and the plug 100 are respectively transfered to take the fixed position by the hydraulic units 50 and 96 as well as the compressed-air cylinder 70. The hydraulic units 50 and 96 are connected by the pipes 48 and 48*a*, and 94 and 94*a* to reducing die 2 and to plug 100, respectively.

The reducing die 2 has an internal surface including an inlet portion 2*b* which tapers rearwardly, a small diameter bearing or throat portion 2*a* and an oppositely inclined outlet portion 2*c*.

A draw unit 110 is arranged on the exit side of the bed 12 and comprises a carriage 112 mounted on the travelling rollers on the bed 12, the carriage 112 carrying a hook 18 and a chuck 114 for gripping the front tip 7*a* of the mother tube or workpiece 7. The carriage 112 is driven by an endless chain 120 encompassing a driven sprocket 122 and a driving sprocket wheel (not shown) mounted in the bed 12.

Figure 10:
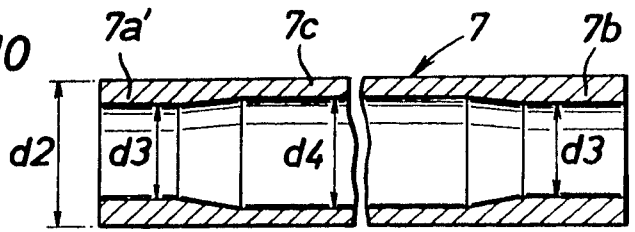
FIG. 10 is a cross section of the seamless metal tube drawn by the plug shown in FIGS. 7(*a*)-(*b*), with its midbody partially cut away.

The seamless metal tube having an inner upset portion on each end shown in FIG. 10 is drawn by the drawing operations schematically shown in FIGS. 7(*a*)–7(*b*). The die holder 26 is located at the left fixed position as shown in FIG. 5(*a*) to locate the die 2 and plug 100 in a first relative position with the forward small diameter portion 106 within the small diameter portion 2*a* of the die and the large diameter bearing portion 104 (d4) of the plug 100 at the rearwardly tapered inlet portion 2*b* as shown in FIG. 7(*a*), while the plug control unit 60 is located at the right fixed position in FIG. 6 for drawing the mother tube 7.

In FIG. 7(*b*), the die holder 26 is located at the left fixed position and the plug is moved to bring the plug and die into a second relative position with the large diameter bearing portion 104(d4) at the small diameter bearing portion 2*a* of the reducing die 2 so that the inner peripheral wall of the drawn tube 7 is expanded by the large diameter bearing portion 104(d4) to draw a thin midbody portion 7*c*. Then, the plug 100 returned from the position at FIG. 7(*b*) back to the position at FIG. 7(*a*) to locate again the large diameter bearing portion 104(d4) at the inlet portion 2*b* of the die 2 and fixed, and the mother tube 7 is drawn forwardly to draw an inner upset portion 7*b*.

Figure 11:
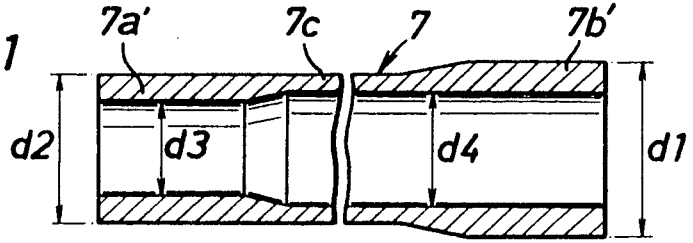
FIG. 11 is a cross section of a seamless metal tube made by the plug shown in FIGS. 8(*a*)-(*h*), with its midbody partially cut away.

The seamless metal tube shown in FIG. 11 is drawn by the steps which are schematically shown in FIGS. 8(*a*)–(*h*). The drawn tube has an inner upset portion 7*a*′ on one end and an outer upset portion 7*b*′ on another end. It is characterized in that the plug 100 has a cylindrically long straight portion between the shank 98 and the rearwardly tapered portion 102.

In FIG. 8(*a*) a forward small diameter cylindrical portion 106 is located at the inlet portion 2*b* of the reducing die 2, and the mother tube 7 and the plug 100 are advanced through the fixed reducing die 2 to locate the forward small diameter portion at the small diameter bearing portion 2*a* and subsequently the plug 100 is fixed in the position of FIG. 8(*c*), i.e. with the plug and die in the first relative position, thus forming the inner upset portion 7*a*′ on one end as shown in FIGS. 8(*b*) and (*c*). In this way, the inner upset portion 7*a*′ is formed on the front end of the drawn tube 7.

In FIGS. 8(*d*) and 8(*e*), the plug 100 is further advanced to locate the large diameter bearing portion 104(d4) at the small diameter bearing portion 2*a* and fixed, and the mother tube 7 is drawn forwardly so that the inner peripheral wall of the drawn tube is expanded by the large diameter bearing portion 104(d4) in order to draw a thin midbody 7*c* of the drawn tube. At this point, the plug and die are in the second relative position. In FIGS. 8(*f*)–(*h*), the die holder 26 is moved rearward by the hydraulic unit 50 so that the large diameter bearing portion 104(d4) is within the forward outlet portion 2*c* of the die, and the mother tube 7 is drawn forwardly so that the inner peripheral wall of the drawn tube is expanded by the large diameter bearing portion 104(d4) of the plug 100 to form an outer upset portion 7*b*′ at the rear end.

Figure 12:
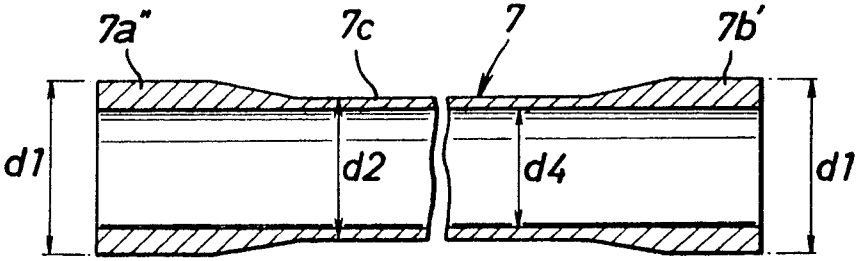
FIG. 12 is a cross section of a seamless metal tube made by the plug shown in FIGS. 9(*a*) to (*g*), with its midbody partially cut away.
Figure 13:
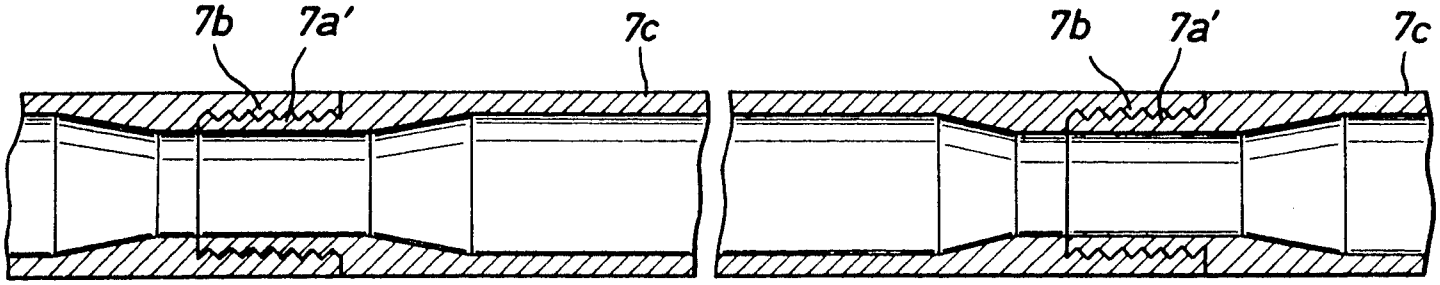
FIG. 13 is a cross section of the seamless metal tubes, partially cut away, which are threadedly screwed to join with each other at the upset portion on each end.

The seamless metal tube having an outer upset portion 7*a*″ on one end and an outer upset portion 7*b*′ on another end shown in FIG. 12 is drawn by the steps shown in FIGS. 9(*a*)–(*g*). The plug 100 includes the rearwardly tapered portion 102, the large diameter bearing portion 104(d4), the forwardly tapered portion 105, the small diameter cylindrical portion portion 106(d3), the rearwardly tapered portion 107 and a forward large diameter bearing portion 108(d4) which are shaped in the stated order.

In FIGS. 9(*a*)–(*f*), the reducing die 2 is fixed, and the mother tube 7 and the plug 100 are advanced through the reducing area of the reducing die 2 to locate the large diameter bearing portion 104(d4) of the plug 100 at the small diameter bearing portion 2*a* of the reducing die 2. Then, the plug 100 is advanced to locate the forward small diameter portion 106 at the small diameter portion of the die 2 in the first relative position as in FIGS. 9(*c*) and 9(*d*). Then the plug 100 is moved again to bring the large diameter bearing portion 104(d4) at the small diameter bearing portion 2*a* of the reducing die, in the second relative position, as shown in FIG. 9(*e*). Accordingly, the inner peripheral wall of the drawn tube 7 is expanded by the forward large diameter portion 108(d4) of the plug 100 so as to draw the outer upset portion 7*a*'' and a midbody 7*c* at the same time, as shown in FIG. 9(*f*).

In FIG. 9(*g*), the plug 100 is moved to locate the small diameter bearing portion 2*a* of the die at the small cylindrical diameter portion 106(d3) of the plug 100 and fixed, i.e. at the first relatively position, and the mother tube 7 is drawn forwardly to expand the inner peripheral wall of the drawn tube by the forward large diameter portion 108(d4), thus forming an outer upset portion 7*b*' at the rear end.

The die holder 26 and the plug fixing main rod 88 are driven to move with each other by means of the hydraulic unit 96 and the compressed-air unit 60 which are mounted on the bed, taking into account the speeds among the drawn tube 7, the reducing die 2 and the plug 100.

For drawing the seamless metal tube having the inner upset portion 7*a*' on one end and the outer upset portion 7*b*' on another end as shown in FIG. 11, the die holder 26 is returned by the hydraulic unit 50 to locate the large diameter bearing portion 104(d4) at the outlet portion 2*c* of the reducing die 2.

After drawing, the plug 100 is again brought back to the starting position by the plug control unit 60, while the die holder 26 is also returned to the starting position by the die control unit 20.

An example of the drawn tube 7 having an upset portion on both ends embodying the novel feature of this invention is given below.

| | EXAMPLE |
|---|---|
| material | Mn—Cr—Mo steel alloy |
| heat treatment | quenching and tempering finally resulted in martensitic structure |
| size after drawing | |
| outer diameter | 88.9 mm |
| thick wall thickness | 6.6 mm |
| thin wall thickness | 5.0 mm |
| length | 2–6 m |
| Shore hardness | 43 |
| strength | 90 kg/mm$^2$ |
| joint of each drawn tube | joined at acme tapered screw thread of the upset end portion |
| use | survey for underground resources such as uranium, metals, etc. or for geological survey |
| rotation | 800–1000 rpm |
| depth | boring into 1000–1500 m under the ground |
| other benefit | mud and slurry are smoothly circulated |

As is clear from the foregoing description and the example, the novel drawing method, plug and draw bench of this invention considerably improves the drawing steps, drawing rate, reduction of area and the like, and it is preferably directed to drawing seamless metal tubes having upset portions on both ends.

While an embodiment of this invention has been described, it is obvious that variations and modifications are possible without departing from the invention. It is desired to cover all such forms of the invention as would be apparent to one skilled in the art, and which falls within the scope of the appended claims.

We claim:

1. A method of cold drawing a seamless metal tube having an upset portion on each end, comprising the steps of:

defining a reducing area between first and second relatively movable members, the first member being a closed periphery reducing die and the second member being a plug secured to the front end of a push-pull rod, the reducing die having an internal surface including a rearward facing inlet portion tapered outwardly in the rearward direction and a forward facing outlet portion tapered forwardly in the forward direction, and a small diameter bearing portion defined by the smaller ends of said tapered inlet and outlet portions meeting in a first plane between said inlet and outlet portions and extending transversely to the directions in which said inlet and outlet portions taper, said plug having a large diameter bearing portion between a portion tapered in a rearward direction and a portion tapered in a forward direction and a forward small diameter cylindrical bearing portion, said large diameter bearing portion lying in a second plane transverse to the length of said push-pull rod with the plug diameter becoming smaller in opposite directions from said second plane;

moving the reducing die and the plug longitudinally with respect to each other at least twice among, and fixing the reducing die and the plug three times in first, second and third relative positions, the first relative position being with the forward small diameter cylindrical bearing portion of the plug being radially aligned with the small diameter bearing portion of the die so that the inner and outer peripheries of a reducing area therebetween respectively have a first inner diameter and first outer diameter, the second relative position being with said first and second planes substantially coplanar and the large diameter bearing portion of the plug being radially aligned with the small diameter bearing portion of the die so that the inner and outer peripheries of the reducing area therebetween respectively have a second inner diameter greater than the first inner diameter and an outer diameter equal to said first outer diameter, and the third relative position being with the large diameter bearing portion of the plug being radially aligned with the outlet portion of the die so that the inner and outer peripheries of the reducing area therebetween respectively have an inner diameter equal to the second inner diameter and a second outer diameter greater than the first outer diameter; and successively drawing a mother tube through the die in a direction from the inlet to the outlet and around the plug in a direction from the rearward tapered portion toward the forward small diameter bearing portion through the reducing area during each of the three times that the plug and die are relatively fixed during the step of moving and fixing the die and plug, for successively forming first, second and third tube portions with inner and outer diameters corresponding to the reducing area during each of the three times, the first and third tube portions having upset portions at the opposite ends of the second tube portion.

2. A method as claimed in claim 1 wherein the step of moving and fixing includes the steps of relatively fixing the plug and die in the first relative position during the first of the three times, then relatively moving the plug to the second relative position and fixing the plug and die in the second relative position during the second of the three times, and then relatively moving the plug and die to the third relative position and fixing the plug and die in the third relative position during the third of the three times, whereby there is formed a tube having a uniform outer diameter in the first and second tube portions and a radially outwardly enlarged inner diameter in the second and third tube portions and a reduced inner diameter upset portion at the first tube portion and a radially enlarged outer diameter upset portion at the third tube portion.

3. A method of cold drawing a seamless metal tube having an upset portion on each end, comprising the steps of:

defining a reducing area between first and second relatively movable members, the first member being a closed periphery reducing die and the second member being a plug secured to the front end of a push-pull rod, the reducing die having an internal surface including a rearward facing inlet portion tapered outwardly in the rearward direction and a forward facing outlet portion tapered forwardly in the forward direction, and a small diameter bearing portion defined by the smaller ends of said tapered inlet and outlet portions meeting in a first plane between said inlet and outlet portions and extending transversely to the directions in which said inlet and outlet portions taper, said plug having a large diameter bearing portion between a portion tapered in a rearward direction and a portion tapered in a forward direction, a forward small diameter cylindrical bearing portion, said large diameter bearing portion lying in a second plane transverse to the length of said push-pull rod with the plug diameter becoming smaller in opposite directions from said second plane and a further large diameter bearing portion having a diameter the same as the first-mentioned large diameter bearing portion and forward of said forward small diameter cylindrical bearing portion;

moving the reducing die and the plug longitudinally with respect to each other to a first relative position in which the forward small diameter cylindrical bearing portion of the plug is radially aligned with the small diameter bearing portion of the die so that the inner and outer peripheries of a reducing area therebetween respectively have a first inner diameter and first outer diameter, and with said further large diameter bearing portion forward of said outlet portion and clear of any reducing die portion, a second relative position being with said first and second planes substantially coplanar and the large diameter bearing portion of the plug being radially aligned with the small diameter bearing portion of the die so that the inner and outer peripheries of the reducing area therebetween respectively have a second inner diameter greater than the first inner diameter and an outer diameter equal to said first outer diameter, and then relatively moving the plug and die back to the first relative position and fixing the plug and die in the first relative position; and successively drawing a mother tube through the die in a direction from the inlet to the outlet and around the plug in a direction from the rearward tapered portion toward the forward small diameter bearing portion through the reducing area during each of the times that the plug and die are relatively fixed during the step of moving and fixing the die and plug, for successively forming first, second and third tube portions with inner and outer diameters corresponding to the reducing area during each of the times, the first and third tube portions having upset portions at the opposite ends of the second tube portion, whereby there is formed a tube having a uniform inner diameter and a radially outwardly enlarged outer diameter upset portions at the first and third tube portions at the respective opposite ends of said second tube portion.

* * * * *